US007621515B2

(12) United States Patent
Jurcinsky et al.

(10) Patent No.: US 7,621,515 B2
(45) Date of Patent: Nov. 24, 2009

(54) PRESSURE DEVICE FOR A CLAMPING SYSTEM

(75) Inventors: Karl Jurcinsky, Bischofsheim (DE); Thomas Ultes, Hochheim (DE)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/997,066

(22) PCT Filed: Jul. 20, 2006

(86) PCT No.: PCT/EP2006/007158

§ 371 (c)(1),
(2), (4) Date: Jan. 28, 2008

(87) PCT Pub. No.: WO2007/014647

PCT Pub. Date: Feb. 8, 2007

(65) Prior Publication Data

US 2008/0185761 A1 Aug. 7, 2008

(30) Foreign Application Priority Data

Jul. 30, 2005 (DE) ..... 10 2005 035 846

(51) Int. Cl.
*B25B 11/00* (2006.01)

(52) U.S. Cl. ..... 269/228; 269/32

(58) Field of Classification Search ..... 269/228, 269/91–94, 32, 20, 24–27
See application file for complete search history.

(56) References Cited

U.S. PATENT DOCUMENTS

| | | | | |
|---|---|---|---|---|
| 2,350,034 | A * | 5/1944 | Herrington | 269/164 |
| 3,245,289 | A | 4/1966 | Nelson | |
| 3,993,297 | A | 11/1976 | Tokunaga | |
| 4,108,589 | A * | 8/1978 | Bunch | 425/393 |
| 5,435,533 | A * | 7/1995 | Weinmann, Jr. | 269/228 |
| 5,924,685 | A * | 7/1999 | Webb | 269/228 |
| 6,595,507 | B2 * | 7/2003 | Dykstra | 269/228 |
| 6,817,603 | B2 * | 11/2004 | Kofod | 269/228 |
| 7,213,805 | B2 | 5/2007 | Nishimura et al. | |
| 2008/0185761 | A1 * | 8/2008 | Jurcinsky et al. | 269/263 |

FOREIGN PATENT DOCUMENTS

| | | |
|---|---|---|
| EP | 0510399 | 10/1992 |
| EP | 1433571 | 6/2004 |
| GB | 2300580 A | 11/1996 |

* cited by examiner

*Primary Examiner*—Lee D Wilson
(74) *Attorney, Agent, or Firm*—Ingrassia Fisher & Lorenz, P.C.

(57) ABSTRACT

The present invention relates to a pressing device for a clamping system. The pressing device is coupled to a clamping element of the clamping system. For this purpose, the pressing device has a pressing arm, which is operationally linked at one end to a clamping element of the clamping system and has an oblong hole on the diametrically opposite free end, in which a fastening rod for a clamping head is situated so it is longitudinally displaceable and rotatable. The pressing device additionally has a twist lock, which secures the angle between clamping head and pressing arm, having a twist lock plate and a lock pin.

15 Claims, 10 Drawing Sheets

PRESSURE DEVICE FOR A CLAMPING SYSTEM

CROSS-REFERENCE TO RELATED APPLICATIONS

This application is a U.S. National-Stage entry under 35 U.S.C. § 371 based on International Application No. PCT/EP2006/007158 filed Jul. 20, 2006, which was published under PCT Article 21(2) and which claims priority to German Application No. DE 10 2005 035 846.2, filed Jul. 30, 2005.

TECHNICAL FIELD

The present invention relates to a clamping system, and more particularly to a pressing device of a clamping system.

BACKGROUND

Clamping systems have a clamping element and a pressing device attached to the clamping element having a clamping head. The pressing device transmits the clamping force of the clamping element to the clamping head. For this purpose, the pressing device has a pressing arm, the pressing arm being operationally linked to the clamping element at one end and having an oblong hole on the diametrically opposite free end, in which a fastening rod for the clamping head is situated so it is longitudinally displaceable and rotatable. This fastening rod allows the clamping head to be fixed on the free end of the pressing arm so it is longitudinally displaceable and rotatable.

A clamping system of this type having a pressing device has the disadvantage that the manufacturing use of the clamping system for clamping standard parts required for manufacturing is extremely limited, because the clamping range around the clamping element for clamping standard parts is minimal. In addition, the degrees of freedom in longitudinal displacement and rotational directions around the fastening rod do not offer any security from maladjustments, because the clamping system does not securely maintain the preadjusted positions. Finally, costly special designs are to be manufactured for any application which goes beyond the clamping range which may be clamped by the known clamping systems, to be able to fix standard parts for measurement and/or testing by clamping or pressing in test equipment construction. Therefore, only special designs and special productions may fulfill the corresponding auxiliary requirements, which additionally strains the design and manufacturing outlay for motor vehicle components.

For secure chucking of standard workpieces, only the adjustability of the clamping pressure of a clamping system is required. Accordingly, the requirement exists, inter alia, for the further two degrees of freedom, such as longitudinal displaceability and rotatability, to be implemented as fixable positions to reduce the readjustment effort. This requirement also cannot be fulfilled by the universal clamping tool known from U.S. Pat. No. 4,747,588, because precisely in a clamping tool of this type, the degrees of freedom of the adjustability of the clamping heads do not assume fixed positions in any way during the required readjustment of the clamping pressure.

In view of the foregoing, at least one object of the present invention is to specify a pressing device of a clamping system which, using standard parts, allows different clamping positions, these predefined clamping positions being able to be maintained without readjustment during a required readjustment of the clamping pressure. A further aspect of the present invention relates to the expansion of the field of use and/or the enlargement of the possible clamping range, each in consideration of reproducibility using the novel pressing device.

SUMMARY

A pressing device is provided according to the present invention which has a pressing arm and a clamping head. The pressing arm of the pressing device has an oblong hole on one end. A fastening rod for the clamping head is situated in this oblong hole so it is longitudinally displaceable and rotatable, the fastening rod fixing the clamping head on the free end of the pressing arm so it is longitudinally displaceable and rotatable. In addition, the pressing device according to the present invention has a twist lock which secures the angle between clamping head and pressing arm, having a twist lock plate and a lock pin.

This pressing device has the advantage that because of the twist lock, the angular position of the clamping head which is set once is fixed in relation to the pressing arm in such a way that the readjustment may concentrate entirely on setting the clamping pressure. The reliability of the clamping system when adapting and readjusting the clamping pressure is thus improved by the twist lock having twist lock plate and lock pin, because the danger of a change of the angle which is set once is maintained even with multiple readjustments of the clamping pressure. Because, in addition, the twist lock may be standardized, retrofitting is possible in all clamping systems already present to increase their positioning reliability in the manufacturing sequence.

In a preferred embodiment of the present invention, the twist lock plate is situated orthogonally to the oblong hole of the pressing device and carries the fastening rod and the lock pin, which projects at a distance from the fastening rod into the oblong hole of the pressing arm, on its top side. In addition, the twist lock plate may have the clamping head and define the angle between clamping head and pressing arm, this defined angle being secured by the lock pin.

An embodiment of the twist lock of this type has the advantage that the twist lock plate having clamping head forms a unit which is connected via the fastening rod to the pressing arm so it is rotatable, the lock pin securing the set angle to the pressing arm. The twist lock plate and the clamping head preferably form a one-piece component. This unity has the advantage that connection elements between twist lock plate and clamping head may be dispensed with, which simplifies and reduces the cost of retrofitting of existing clamping systems.

In a preferred embodiment of the present invention, the lock pin and the clamping head are situated diametrically opposite one another in relation to the fastening rod on the twist lock plate. In this case, a linear orientation of the clamping head in relation to the pressing arm results.

In a further preferred embodiment of the present invention, the twist lock plate has a curved hole pattern track diametrically opposite the clamping head in relation to the fastening rod for defining and securing the angle between clamping head and pressing arm. The lock pin of the twist lock plate is fixable in the hole pattern track. It is thus possible that the lock pin permits a pattern of angles between clamping head and pressing arm by the predefined positions in the hole pattern track. A hole pattern track of this type has the advantage that the individual possible positions of the lock pin may be reliably fixed.

In a further preferred embodiment of the present invention, the twist lock plate has a curved oblong hole slot diametrically opposite the clamping head in relation to the fastening rod for defining and securing the angle between clamping head and pressing arm. In this case, the lock pin is fixable in the oblong hole slot. This has the advantage that any arbitrary intermediate angle may be secured by the lock pin. The setting of the angle and/or the pre-assembly of the angle is more complex than with a predefined hole pattern track in the twist lock plate, however.

In a further embodiment of the present invention, the pressing device has an adapter plate for enlarging the angle between clamping head and pressing arm, the adapter plate being situated orthogonally to the oblong hole between the pressing arm and the twist lock plate having clamping head. Using an adapter plate of this type, the adjustability of the angle, which is already predefined by the curved oblong hole slot and/or the curved hole pattern track in the twist lock plate, may be enlarged further, in that the fastening rod, in the sequence from bottom to top, mechanically connects the twist lock plate having clamping head, the adapter plate, and the free end of the pressing arm to one another. For this purpose, a lock pin is provided on the top side of the adapter plate, which engages in the oblong hole of the pressing arm, while a second lock pin in the form of a removable connection element on the bottom side of the adapter plate engages in the curved oblong hole slot and/or the curved hole pattern track of the twist lock plate having clamping head.

For this purpose, a through hole for the fastening rod and, at a distance thereto, a hole for the lock pin are provided in the adapter plate. In addition, the adapter plate has at least one further through hole which is situated on a circular line around the through hole for the fastening rod, the circular line having a radius corresponding to the distance between fastening rod and lock pin. Instead of a bottom second lock pin, the further through hole of the adapter plate may have a removable connection element for defining and securing the angle between pressing arm and clamping head and for mechanically connecting the twist lock plate and the adapter plate. This connection element may preferably be a screw which engages in a thread provided in the further through hole of the adapter plate.

Furthermore, the clamping head is implemented as forked, because this type of clamping head includes a broad field of use in retaining standard manufacturing parts by clamping in manufacturing and testing.

To expand the clamping range for the novel pressing device, the pressing device has a cantilever. This cantilever lengthens the pressing arm. For this purpose, the cantilever has a fastening rod and a lock pin on a chucked end, which are situated and fixed in the oblong hole of the pressing arm. On the diametrically opposite free end, the cantilever has through holes and/or threaded holes for a second fastening rod and a second lock pin for receiving the twist lock plate having clamping head and/or for receiving the adapter plate.

A cantilever of this type may preferably be produced in five standardized lengths, to retain correspondingly distant twist lock plates having clamping heads in multiple standardized lengths and to further increase the variation possibilities of the clamping system. Finally, the adapter plate may be implemented differently for the left or right side of the pressing arm to increase the angle range. With the aid of standardized auxiliary parts of this type, the field of use of conventional clamping systems may be significantly expanded, the volume range of standard components which may be grasped and/or chucked being significantly enlarged in relation to a typical clamping system:

In summary, it may be stated that the present invention allows the following advantages in relation to systems which are known from the prior art.

1. A cost saving by simplifying and unifying the design and by dispensing with further detailing of existing systems;
2. a cost saving in the manufacturing by standardized elements for the novel pressing device, so that instead of special productions, mass production is possible;
3. a cost saving in the assembly by predefined standardized processes in the building block system;
4. a cost saving in maintenance and alteration work, because only standardized parts are used and thus cost-effective replaceability of elements of the clamping system is made possible;
5. a coverage of a larger clamping range around the conventional clamping element using novel standard parts of the novel clamping system.

BRIEF DESCRIPTION OF THE DRAWINGS

The present invention will hereinafter be described in conjunction with the following drawing figures, wherein like numerals denote like elements.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
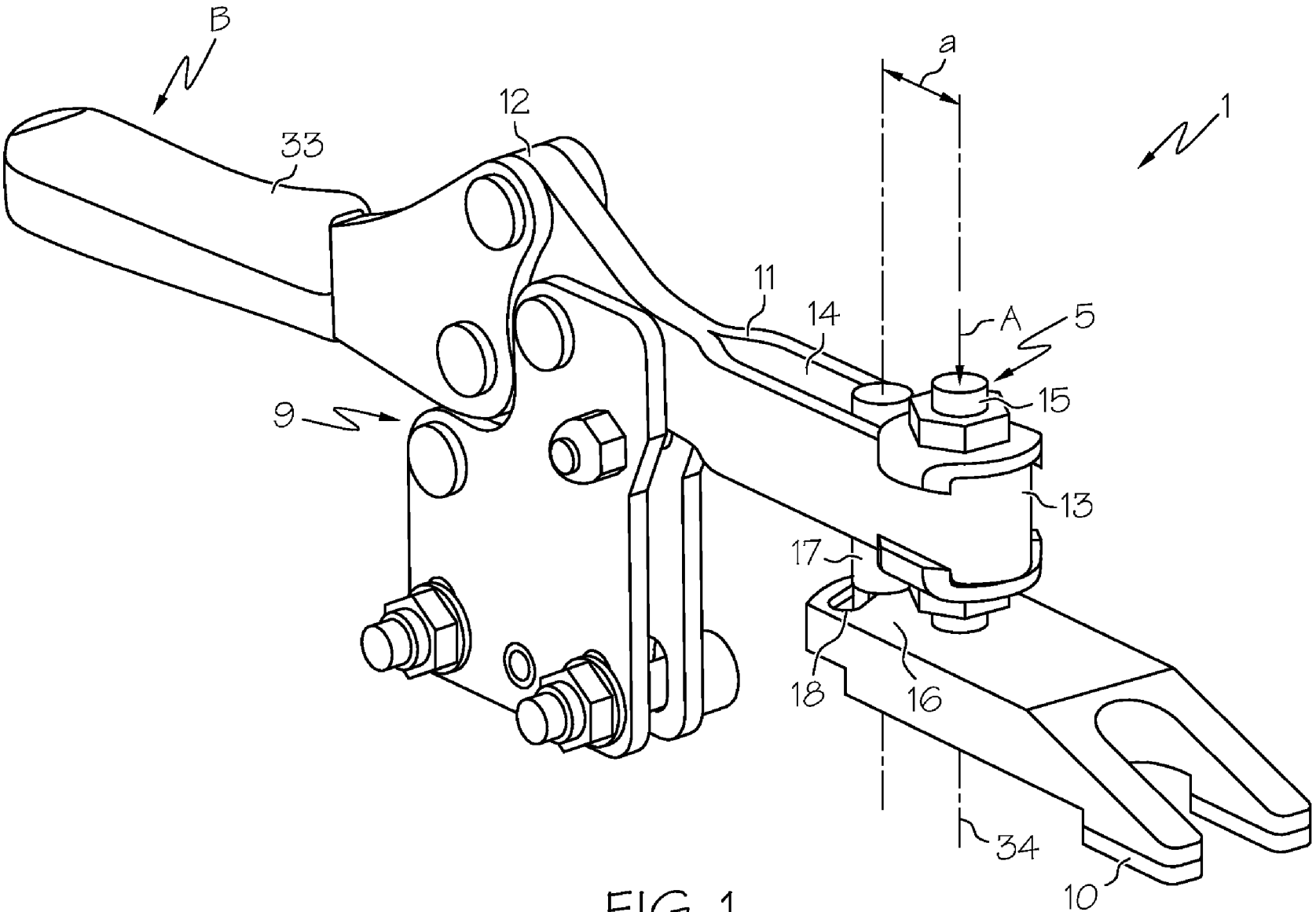
FIG. 1 shows a schematic perspective view of a clamping system having a pressing device of a first embodiment of the present invention.

FIG. 1 shows a schematic perspective view of a clamping system 1 having a pressing device 5 of a first embodiment of the present invention. The clamping system 1 has a clamping element 9 and a pressing device 5, the pressing device 5 being operationally linked to the clamping element 9 via a pressing arm 11 of the pressing device 5. The clamping element 9 of the clamping system 1 has a clamping lever 33 in this first embodiment of the present invention, which is engaged with a chucked end 12 of the pressing arm 11 and exerts a clamping pressure in the arrow direction A on the free end 13 of the pressing arm 11 when the clamping lever 33 is repositioned in the arrow direction B from a rest position (not shown) into the clamping position shown. However, the mechanical clamping force exerted on the pressing device by the clamping lever and the clamping element may also be applied hydraulically, pneumatically, and/or electromechanically by corresponding clamping devices of the clamping system. The pressing arm 11 has an oblong hole 14 in the area of the free end 13 of the pressing arm 11, a fastening rod 15 being situated so it is longitudinally displaceable in the oblong hole 14. The fastening rod 15 is connected fixed to a twist lock plate 16, which is situated orthogonally to the axis 34 of the fastening rod 15.

In this embodiment of the present invention, this twist lock plate 16 has a forked clamping head 10 on one end and a curved hole pattern track 18 on the diametrically opposite end of the twist lock plate 16 in relation to the fastening rod 15. A lock pin 17, which projects at a distance from the fastening rod 15 into the oblong hole 14 of the pressing arm 11, is fixed in the hole pattern track 18.

Working together with the lock pin 17, the twist lock plate 16 ensures that upon a readjustment of the contact pressure, the position of the forked clamping head 10 is maintained. The twisting of the forked clamping head 10 around the axis 34 of the fastening rod 15 is practically precluded because of this twist lock by the twist lock plate 16 and the lock pin 17, so that the linear orientation of the forked clamping head 10 shown here remains completely maintained upon the pressure readjustment.

Figure 2:
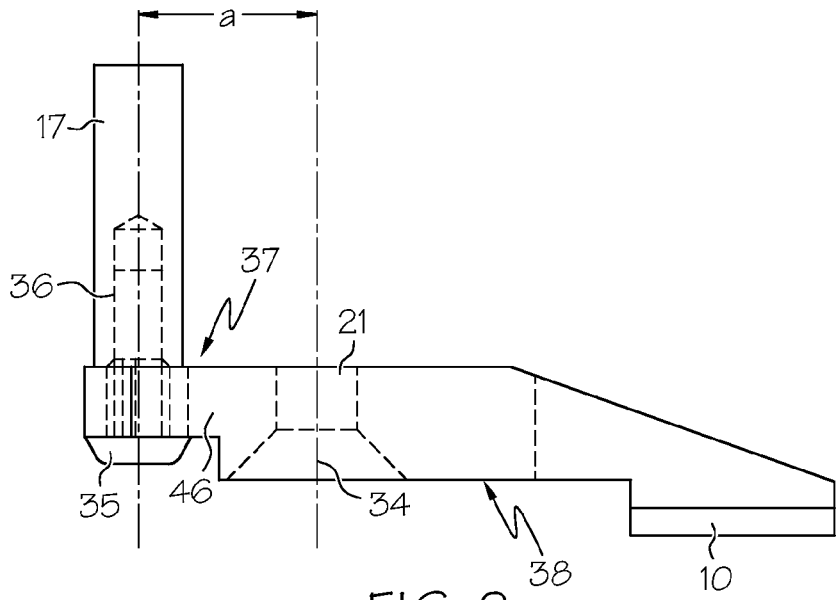
FIG. 2 shows a schematic side view of a twist lock plate having lock pin.

FIG. 2 shows a schematic side view of the twist lock plate 16 having lock pin 17. This lock pin 17 is situated at a distance a from a through hole or threaded hole 21 for the fastening rod, which is shown in FIG. 1. The lock pin 17 is situated perpendicularly to the top side 37 of the twist lock plate 16. The lock pin 17 is fixed by a screw 35, which is engaged with an internal thread 36 of the lock pin 17 from the bottom side 38 of the twist lock plate 16. The clamping head 10, which is situated diametrically opposite to the lock pin 17 in relation to the hole 21 for the fastening rod, projects on the bottom side 38 of the twist lock plate 16.

Figure 3:
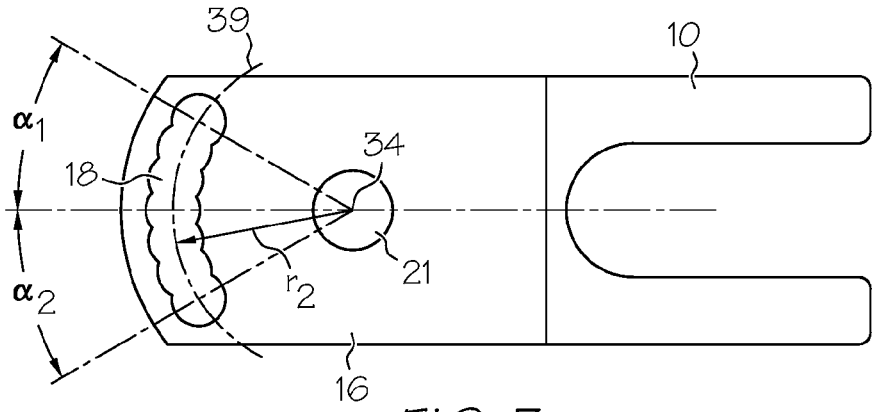
FIG. 3 shows a schematic top view of a twist lock plate having clamping head.

FIG. 3 shows a schematic top view of the twist lock plate 16 having clamping head 10. The twist lock plate 16 has a central through hole 21 for the fastening rod. In the modification shown in FIG. 3, the twist lock plate 16 has a hole pattern track 18 on a settable clamping range 39, the settable clamping range 39 having a radius r, which corresponds to the distance a shown in FIG. 2. The lock pin 17 shown in FIG. 2 may be fixed in one of the positions of the hole pattern and thus define and secure an angle $\alpha 1$ for the orientation of the clamping head 10 in relation to the above-mentioned pressing arm 11.

Figure 4:
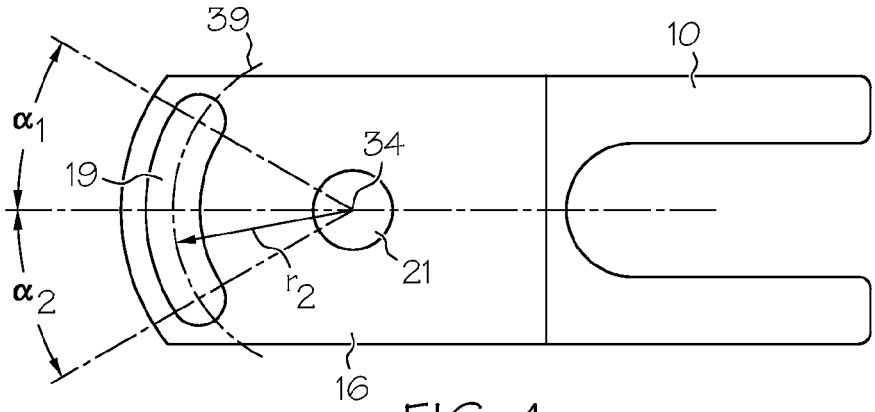
FIG. 4 shows a schematic top view of a modified twist lock plate having clamping head.

FIG. 4 shows a schematic top view of a modified twist lock plate 16 having clamping head 10. The modification is that instead of the curved hole pattern track 18 shown in FIG. 3, a corresponding curved oblong hole slot 19 is situated. Using this oblong hole slot 19, the angle $\alpha 1$ between the clamping head 10 and the above-mentioned pressing arm 11 of the pressing device 5 may be secured continuously by appropriate positioning of the lock pin in the oblong hole slot 19.

Figure 5:
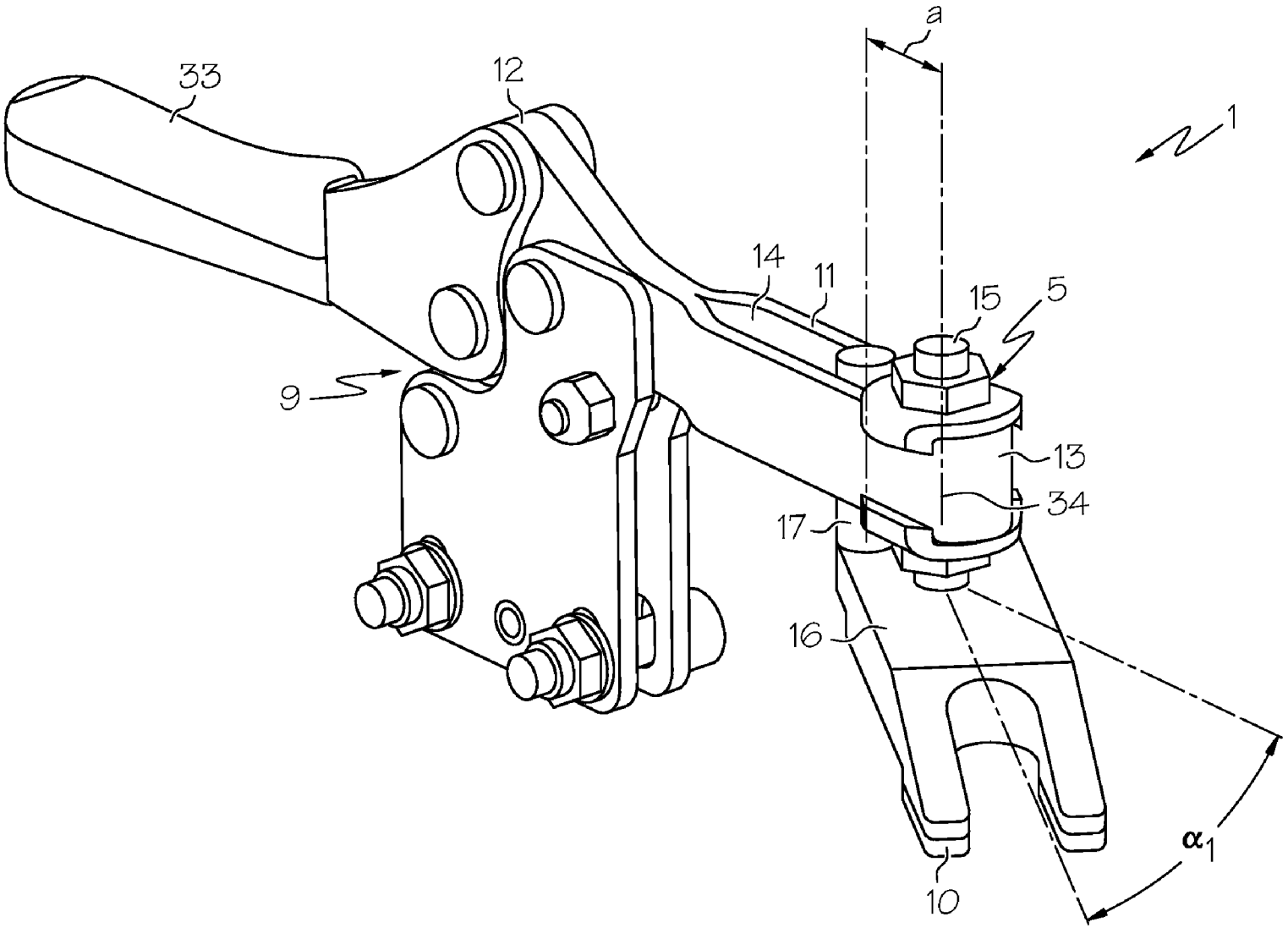
FIG. 5 shows a schematic perspective view of the clamping system from FIG. 1 having preset and secured angle between pressing arm and clamping head of the pressing device according to the first embodiment of the present invention.

FIG. 5 shows a schematic perspective view of the clamping system 1 from FIG. 1 having preset and secured angle $\alpha 1$ between pressing arm 11 and clamping head 10. The dimension of the angle $\alpha 1$ is a function of the dimension of the twist lock plate 16 and the curved oblong hole slot and/or the curved hole pattern track introduced therein. The further components having identical functions as in the preceding figures are identified using identical reference numerals and are not explained again.

Figure 6:
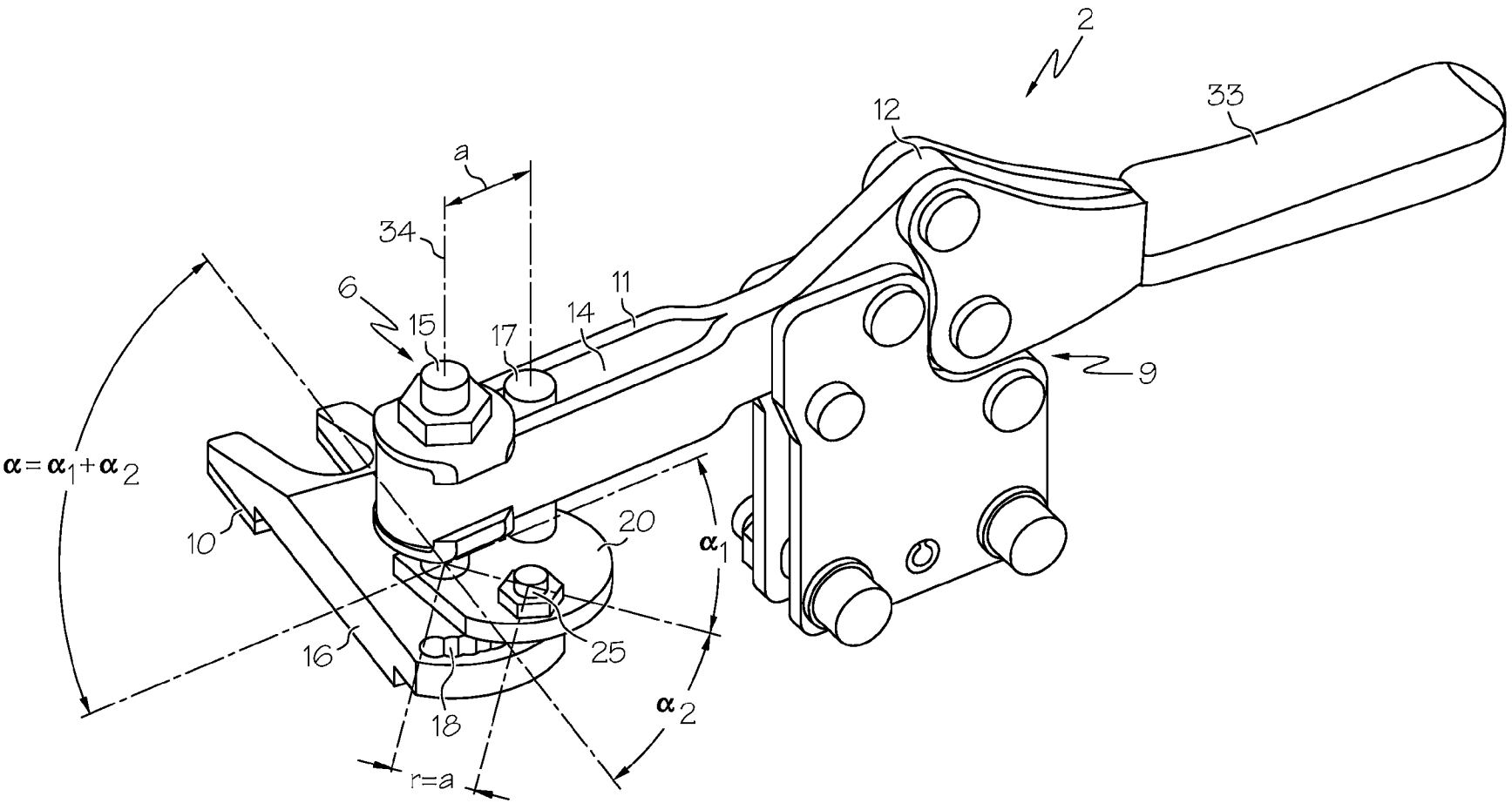
FIG. 6 shows a schematic perspective view of a clamping system having a pressing device of a second embodiment of the present invention.

FIG. 6 shows a schematic perspective view of a clamping system 2 having a pressing device 6 according to a second embodiment of the present invention. Components having identical functions as in the preceding figures are identified using identical reference numerals and are not explained again. The difference to the embodiment from FIG. 1 and FIG. 5 is that an adapter plate 20 is situated between the pressing arm 11 and the angularly-adjustable twist lock plate 16. Using this adapter plate 20, an additional angle $\alpha 2$ is added to the angle $\alpha 1$ in relation to the longitudinal extension of the pressing arm 11, so that angles $\alpha$ having $0 \leqq \alpha \leqq 100°$ may be achieved.

For this purpose, the adapter plate 20 has a hole for the fastening rod 15, which is situated centered over the hole provided in the twist lock plate 16. In addition, the adapter plate 20 now carries the lock pin 17, which fixes the adapter plate 20. Moreover, the adapter plate 20 has a removable connection element 25, which is engaged with the hole pattern track 18 and/or an oblong hole slot of the twist lock plate 16. The hole for a removable connection element 25 of this type lies on a circular segment having a radius r, which corresponds to the distance a between the fastening rod 15 and the lock pin 17. This geometrical configuration is explained by following FIGS. 7 and 8.

Figure 7:
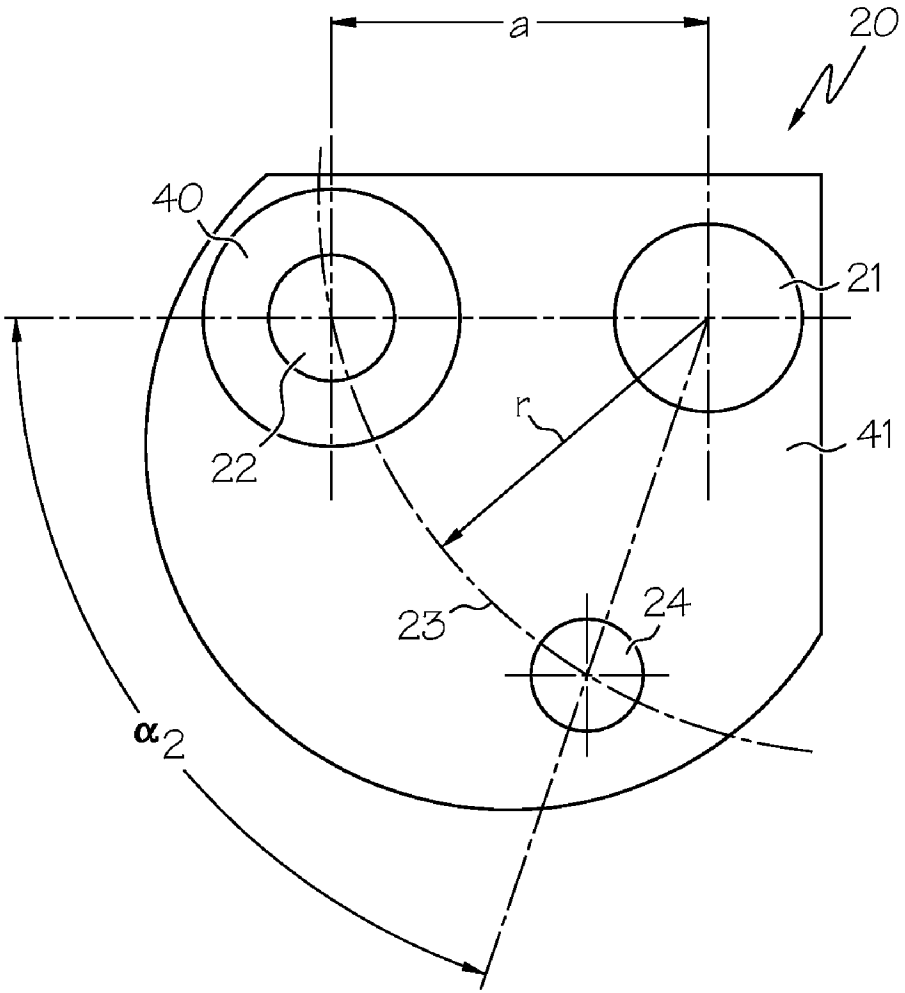
FIG. 7 shows a schematic view of the bottom side of an adapter plate.

FIG. 7 shows a schematic view of the bottom side 41 of an adapter plate 20. The adapter plate 20 has at least three holes 21, 22, and 24: a central hole 21 for the fastening rod and a hole 22 for the lock pin at the distance a thereto. On a circular line 23, which has a radius r, a further hole 24 is situated at a distance from the hole 22 in the adapter plate 20 at an angle $\alpha 2$. This further hole 24 receives the removable connection element 25 shown in FIG. 6. The radius r of the circular line 23 corresponds to the distance a between the hole 21 and the hole 22. The further hole 24 is offset from the hole 22 by the angle $\alpha 1$ in relation to the hole 21. The clamping head 10, which is shown in FIG. 6, may thus be situated offset in relation to the longitudinal axis of the pressing arm 11 by a total angle $\alpha = \alpha 1 + \alpha 2$, the total angle $\alpha$ being able to be preset and secured both right and also left of the pressing arm.

Figure 8:
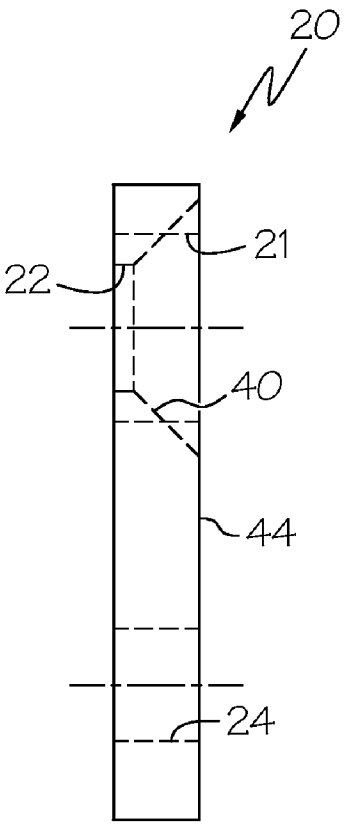
FIG. 8 shows a schematic side view of the adapter plate from FIG. 7.

FIG. 8 shows a schematic side view of the adapter plate 20 from FIG. 7. The holes 21 and 22 and additionally the further hole 24 are shown placed one above another in the side view using dashed lines. For this purpose, the hole 22 has a depression 40 for a countersunk head screw for fastening the lock pin 17, which is shown in FIG. 6. This depression 40 has the advantage that the bottom side 41 of the adapter plate 20 remains level after fixing the lock pin using a corresponding countersunk head screw.

Figure 9:
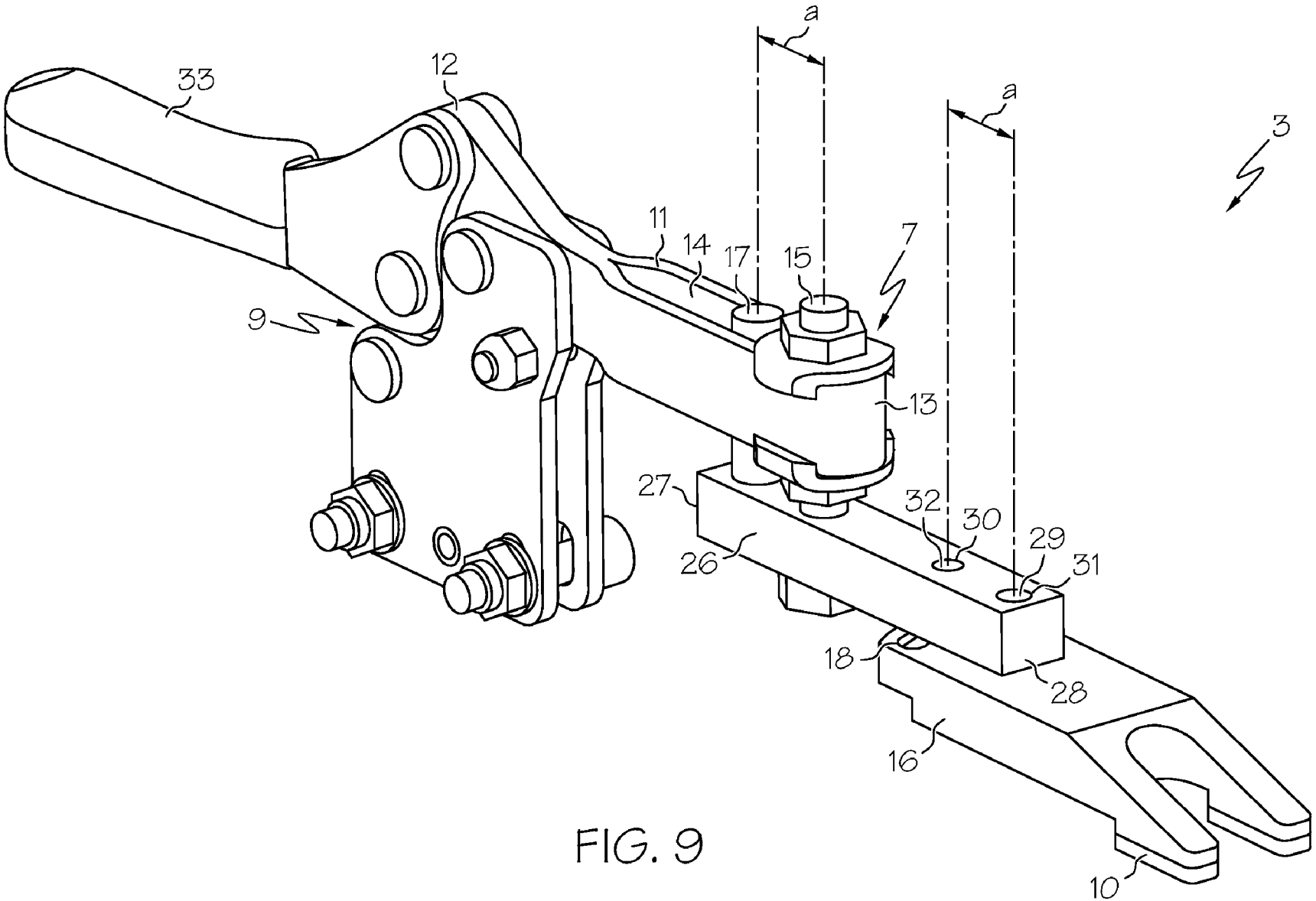
FIG. 9 shows a schematic perspective view of a clamping system having a pressing device of a third embodiment of the present invention.

FIG. 9 shows a schematic perspective view of a clamping system 3 having a pressing device 7 of a third embodiment of the present invention. The pressing device 7 from FIG. 9 differs from the preceding embodiment in that a cantilever 26 is attached to the free end 13 of the pressing arm 11. For this purpose, the cantilever 26 has, on its end 27 fixed on the end 13 of the pressing arm 11, in addition to the fastening rod 15, the lock pin 17 at a distance a, which projects into the oblong hole 14 of the pressing arm 11. The free end 28 of the cantilever 26 carries the twist lock plate 16 having the clamping head 10 on its bottom side. For this purpose, the cantilever 26 has a through hole 29 in which a second fastening rod 31 is situated, and a further through hole 30 at the distance a to the first through hole 29, in which a second lock pin 32 is situated, which holds the twist lock plate 16 in position. The lock pin 32 is engaged with a curved grid hole track 18 of the twist lock plate 16, by which the position of the clamping head 10 is secured. The second lock pin 32 may also be fixed in a curved oblong hole slot 19, as shown in FIG. 4.

Figure 10:
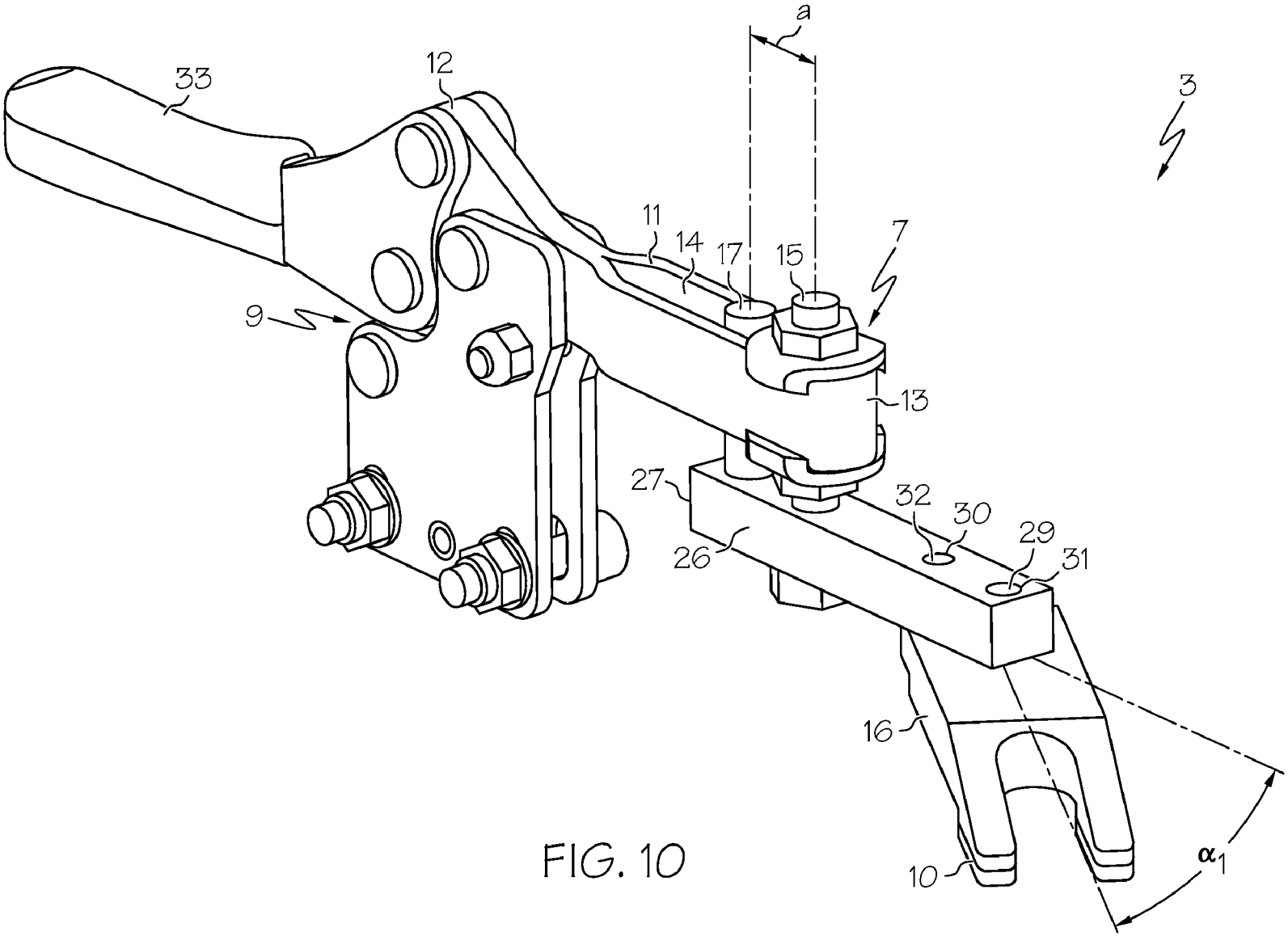
FIG. 10 shows a schematic perspective view of the clamping system from FIG. 9 having preset and secured angle between a cantilever and a clamping head of the pressing device according to the third embodiment of the present invention.

FIG. 10 shows a schematic perspective view of the clamping system 3 having the pressing device 7 from FIG. 9 having preset and secured angle α1 between a cantilever 26 and a clamping head 10. Components having identical functions as in the preceding figures are identified using identical reference numerals and are not explained again. To set the angle α1, the lock pin 32 is solely fixed offset in the through hole 30 in the oblong hole slot or in the hole pattern track 18 of the twist lock plate 16.

Figure 11A:
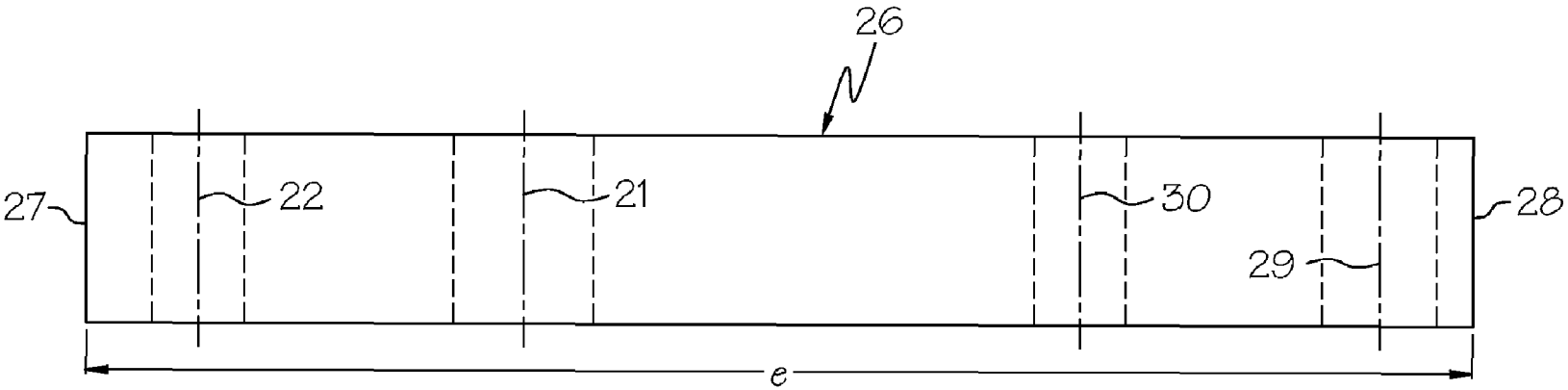
FIG. 11 schematically shows a side view (11*a*) and a front view (11*b*) of a cantilever.
Figure 11B:
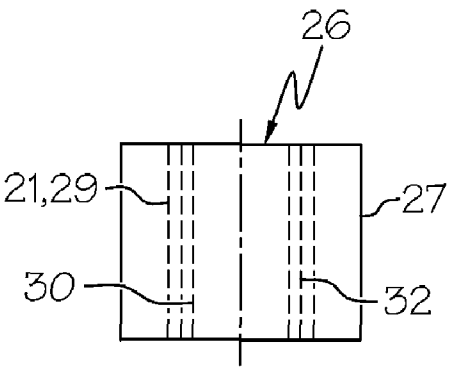

FIG. 11 schematically shows a side view in FIG. 11*a* and a front view in FIG. 11*b* of a cantilever 26. The length 1 of the cantilever 26 may vary, or different standardized lengths 1 of the cantilever 26 may be provided in a toolset to ensure the most variable possible clamping system. The cantilever 26 has two holes 21 and 22 on the end 27, which is fixed on the pressing arm of the pressing device, the hole 21 being provided for attaching the fastening rod and the hole 22 being situated in the cantilever 26 for attaching the lock pin. The holes on the free end 28, which is to carry the twist lock plate having the clamping head, have their diameters tailored to the holes 21 and 22, the hole 29 being provided for a second fastening rod and the hole 30 for a second lock pin. The second lock pin may have a smaller diameter than the first lock pin, so that the through holes 22 and 30 differ in diameter.

Figure 12:
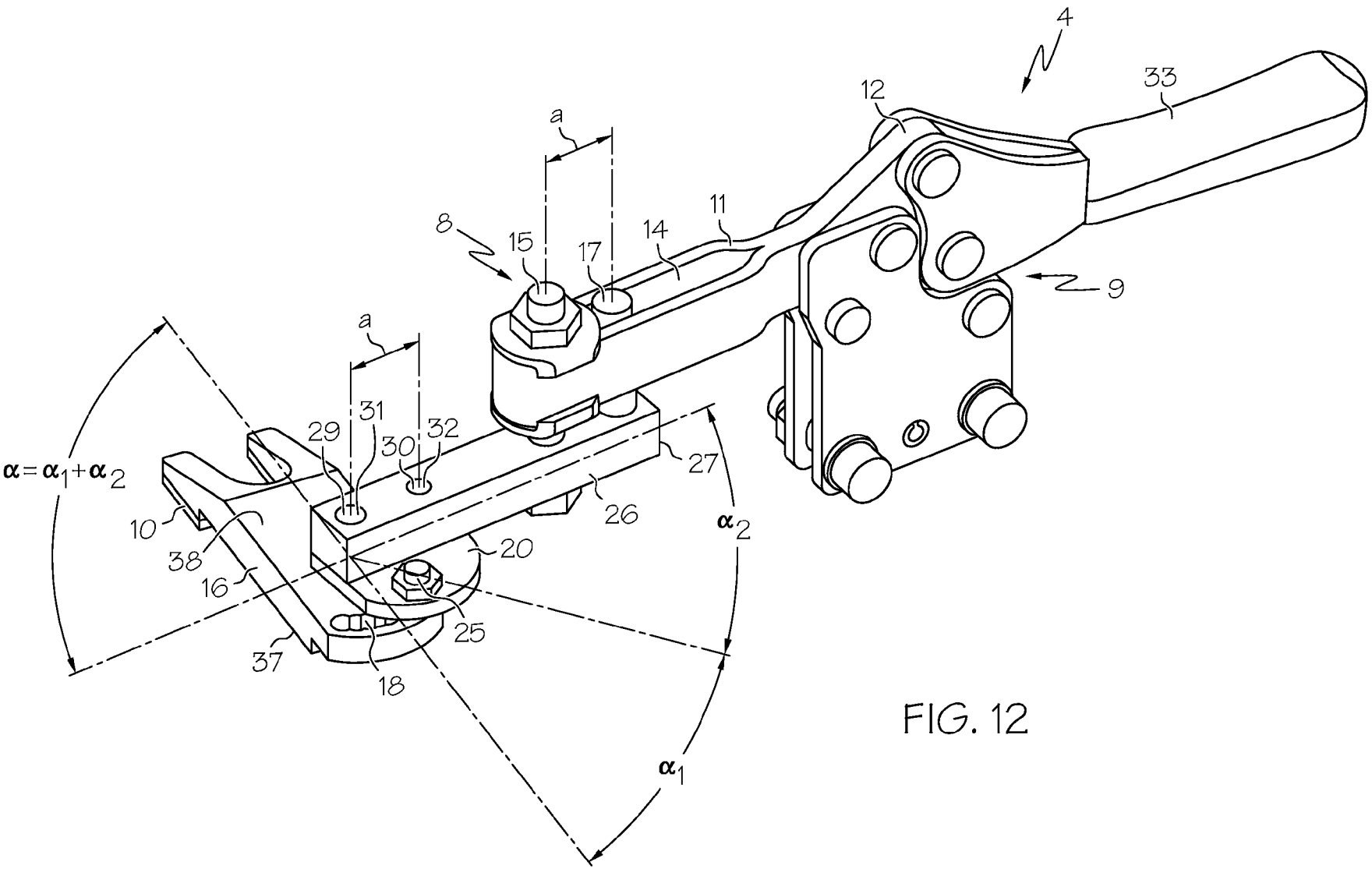
FIG. 12 shows a schematic perspective view of a clamping system having a pressing device of a fourth embodiment of the present invention.

FIG. 12 shows a schematic perspective view of a clamping system 4 having a pressing device 8 of a fourth embodiment of the present invention. This fourth embodiment of the present invention differs from the third embodiment of the present invention in that in addition to the cantilever 26, an adapter plate 20 is also provided on the free end of the cantilever 26. Using this adapter plate 20, as already explained above, the angle α between the longitudinal extension of the pressing arm 11 having cantilever 26 and the clamping head 10 may be enlarged further.

Figure 13:
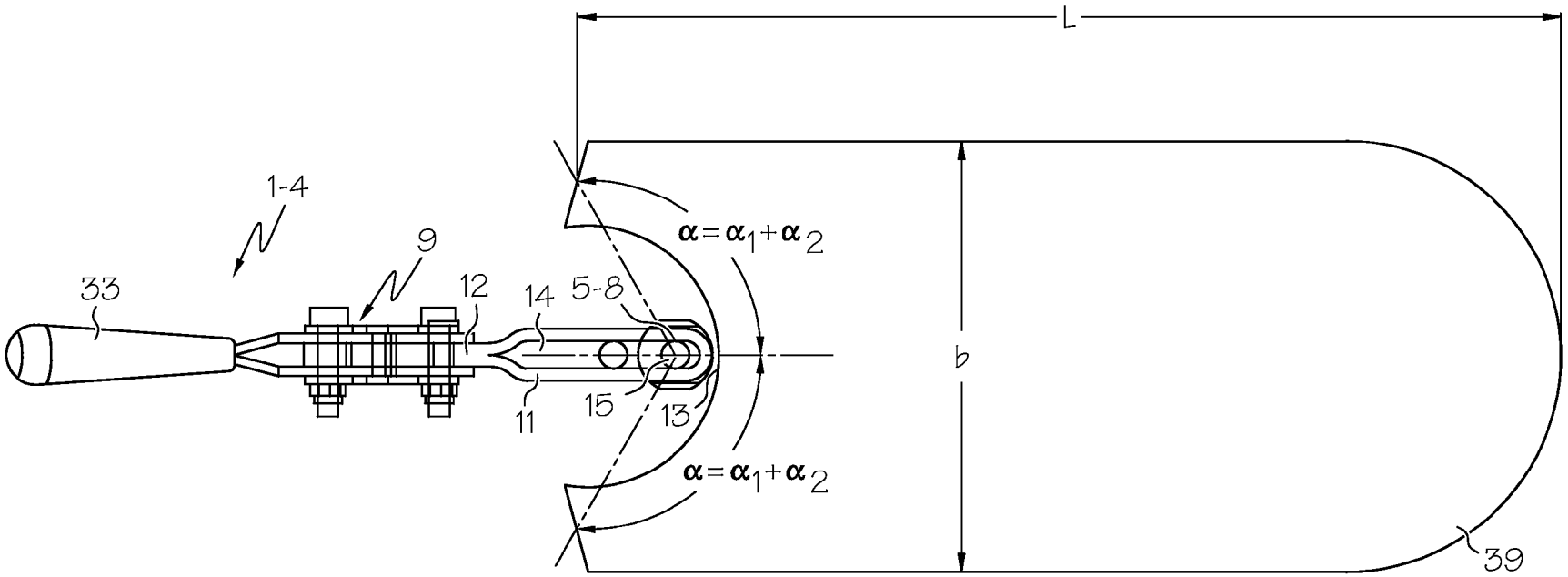
FIG. 13 shows a schematic top view of a clamping system and the possible settable clamping range of a clamping head of the pressing device.

FIG. 13 shows a schematic top view of a clamping system 1 through 4 having a pressing device 5 through 8 and the possible settable clamping range 39 of a clamping head of this pressing device 5 through 8. The clamping range 39 may comprise a length L of approximately 230 mm and a width b of approximately 100 mm, for example. The length L of the clamping range 39 is a function of the orders of magnitude of the cantilever and the twist lock plate having clamping head, and the width b of the clamping range 39 is a function of the pivot angle α, by which the clamping head is pivoted around the fastening rod on the free end of a pressing device 4. Furthermore, the width b of the clamping range 39 is influenced by the order of magnitude of the twist lock plate having clamping head. For this purpose, the pivot angle α may be mounted with and without cantilever by the adapter plate, as explained above, in different embodiments of the pressing arm 11.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A pressing device comprising a pressing arm and clamping head, the pressing arm having an oblong hole in which a fastening rod for the clamping head is situated such that the fastening rod is longitudinally displaceable and rotatable, the fastening rod fixing the clamping head to the pressing arm so that the clamping head is also longitudinally displaceable and rotatable, wherein the clamping head has a twist lock which secures a variable horizontal angle between clamping head and pressing arm, the twist lock comprising a twist lock plate oriented perpendicular to a lock pin that is oriented parallel to the fastening rod.

2. The pressing device according to claim 1, wherein the twist lock plate) is situated orthogonally to the oblong hole of the pressing device and carries the fastening rod, and the lock pin projects into the oblong hole at a distance from the fastening rod, the twist lock plate having the clamping head and defining the horizontal angle between clamping head and pressing arm and securing this defined angle through the lock pin.

3. The pressing device according to claim 1, wherein the twist lock plate and the clamping head are in one piece.

4. The pressing device according to claim 2, characterized in that the lock pin (17) and the clamping head (10) are situated diametrically opposite one another in relation to the fastening rod (15) on the twist lock plate (16).

5. The pressing device according to claim 1, wherein the twist lock plate has a curved hole pattern track diametrically opposite to the clamping head in relation to the fastening rod for defining and securing the angle between clamping head and pressing arm, the lock pin being fixable in the hole pattern track.

6. The pressing device according to claim 1, wherein the twist lock plate has a curved oblong hole slot diametrically opposite to the clamping head in relation to the fastening rod for defining and securing the horizontal angle between clamping head and pressing arm, the lock pin being fixable in the oblong hole slot.

7. The pressing device according to claim 1, wherein the pressing device has an adapter plate for enlarging the horizontal angle between clamping head and pressing arm, the adapter plate being situated orthogonally to the oblong hole and between the pressing arm and the twist lock plate having clamping head.

8. The pressing device according to claim 7, wherein the adapter plate has a through hole for the fastening rod and, at a distance thereto, a hole for the lock pin.

9. The pressing device according to claim 8, wherein the adapter plate has at least one further through hole, which is situated on a circular line around the through hole for the fastening rod, the circular line having a radius, which corresponds to a distance between fastening rod and lock pin.

10. The pressing device according to claim 9, wherein the further through hole of the adapter plate has a removable connection element for defining and securing the horizontal angle between pressing arm and clamping head and for mechanically connecting twist lock plate and adapter plate.

11. The pressing device according to claim 1, wherein the clamping head is forked.

12. The pressing device according to claim 1 further comprising a cantilever, which lengthens the pressing arm, and which has a fastening rod and a lock pin on a chucked end, which are situated in the oblong hole of the pressing arm, and has threaded holes on a diametrically opposite free end for a second fastening rod and a second lock pin.

13. The pressing device according to claim 1 further comprising a clamping element, which may be actuated and exerts a clamping force on the clamping head.

14. The pressing device according to claim 13, wherein the clamping element has a clamping lever for applying a clamping force.

15. The pressing device according to claim 13, wherein the pressing arm of the pressing device is operationally linked at one end to the clamping element and has the oblong hole on the diametrically opposite free end.

* * * * *